US005498177A

United States Patent [19]

Tsuji

[11] Patent Number: 5,498,177

[45] Date of Patent: Mar. 12, 1996

[54] STRUCTURE FOR THIN-WALLED HINGE

[75] Inventor: Masanori Tsuji, Shizuoka, Japan

[73] Assignee: Yazaki Corporation, Tokyo, Japan

[21] Appl. No.: 478,837

[22] Filed: Jun. 7, 1995

Related U.S. Application Data

[63] Continuation of Ser. No. 200,498, Feb. 23, 1994, abandoned.

[30] Foreign Application Priority Data

Feb. 23, 1993 [JP] Japan ..... 5-056377

[51] Int. Cl.[6] ..... H01R 13/40

[52] U.S. Cl. ..... 439/596; 439/752

[58] Field of Search ..... 220/339, 375; 439/451, 521, 595, 596, 752

[56] References Cited

U.S. PATENT DOCUMENTS

| | | | |
|---|---|---|---|
| 4,747,511 | 5/1988 | Dutt et al. | 220/375 X |
| 4,793,501 | 12/1988 | Beck | 220/339 X |
| 4,793,502 | 12/1988 | Beck | 220/339 X |
| 5,254,314 | 10/1993 | Yu et al. | 220/339 X |
| 5,292,262 | 3/1994 | Endo et al. | 439/752 |

FOREIGN PATENT DOCUMENTS 0058237 8/1982 European Pat. Off. .

2138639 10/1984 United Kingdom .

*Primary Examiner*—Khiem Nguyen

*Attorney, Agent, or Firm*—Sughrue, Mion, Zinn, Macpeak & Seas

[57] ABSTRACT

An object of the present invention is to provide a structure employable for a thin-walled hinge(s) which assures that there does not arise a malfunction that each thin-walled hinge is undesirably bent and that an operation for connecting two components to each other and disengaged from each other can be performed at an improved efficiency. A pair of thin-walled hinges for firmly connecting a double engagement member to a housing main body are designed in the form of a pair of rectangular band-shaped pieces for connecting a lower wall of the housing main body on the male terminal insert side to a base end portion of a plate portion. To assure that opening and closing of the double engagement member are not obstructed by the thin-walled hinges, each thin-walled hinge is designed such that it has a small thickness enough to allow it to be deflected with a very low intensity of power, the width of each thin-walled hinge is continuously reduced from the connecting portion on the lower wall side toward the connecting portion of the plate portion side while each thin-walled hinge maintains a constant thickness therebetween, and a width $W_1$ of each thin-walled hinge on the housing main body side is dimensioned to be larger than a width $W_2$ of the same on the double engagement member side.

6 Claims, 4 Drawing Sheets

STRUCTURE FOR THIN-WALLED HINGE

This is a Continuation of application Ser. No. 08/200,498, filed Feb. 23, 1994 now abandoned.

BACKGROUND OF THE INVENTION

1. Field of the Invention

The present invention relates generally to a hinge including a fulcrum for turning movement thereof in the case that two components to be detachably combined with each other are integrally connected to each other, and subsequently, they are disconnected from each other as desired. More particularly, the present invention relates to improvement of a thin-walled hinge of the foregoing type to be integrally molded with the two components.

2. Related Art

A flexible thin-walled hinge including a fulcrum for turning movement thereof in the case that two components to be detachably combined with each other are integrally connected to each other and disconnected from each other as desired is hitherto practically used in various utilization fields in industries.

The flexible thin-walled hinge having the aforementioned structure has advantages that e.g., in the case of a container having a lid attached thereto, a structure employable for a hinge of the foregoing type for allowing the lid to be turnably openably connected to a housing of the container can easily be produced, and moreover, an assembly of the lid and the housing of the container can integrally be molded at a reduced cost on a mass production line by employing an injection molding process. Owing to the foregoing advantages, many flexible thin-walled hinges each constructed in the above-described manner are used for electrical components such as fuse boxes, protectors for wire harnesses or the like in addition to containers each having a lid attached thereto as mentioned above.

In view of the fact that a thin-walled hinge of the foregoing type is alternately subjected to compressive and tensile stresses due to bending and expanding thereof caused as it is opened and closed, it is constructed such that it can satisfactorily stand against the compressive and tensile stresses induced as it is opened and closed, by designing it to have a small thickness so as to maintain the radius of curvature in relatively large when it is bend.

In addition, with respect to a terminal housing, it is already known that a double engagement member is disposed on a main body of the housing via a thin-walled hinge in order to increase an intensity of retaining power to be applied to a terminal primarily engaged with the housing by actuating conventional engaging means. FIGS. 6 to 8 show by way of perspective view the structure of a terminal housing of the foregoing type including a double engaging member.

In the shown case, the terminal housing includes a partition wall 56 at the intermediate part of a housing main body 41 in order to prevent a male terminal 50 from being disconnected from the housing main body 41 in the forward direction, and the partition wall 56 is projected inward of the inner surfaces of a front wall 42*a* and a rear wall 42*b* of the housing main body 41. To prevent the male terminal 50 from being vibratively displaced in the housing main body 41, a lower housing main body 43 located below the partition wall 56 is designed to have a small width between a front wall 43*a* and a rear wall 43*b* compared with an upper housing main body 42. In addition, the front wall 43*a* of the lower housing main body 43 located below the partition wall 56 includes a terminal vibrative displacement preventing portion for preventing the male terminal 50 from being vibratively displaced, and the lower end of the terminal vibrative preventing portion is kept open to the outside in the form of an opening portion 46 (see FIG. 8).

A housing lance 47 serving as a primary engagement member for the male terminal 50 is disposed on the inner surface of one of the opposite side walls 42*c* of the upper housing main body 42, and moreover, engagement protuberances 48 for holding a double engagement member 44 to be described later in the locked state are disposed on the outer surfaces of the opposite side walls 42*c* of the upper housing main body 42.

The double engagement member 44 is prepared by bending the opposite side plates 44*b* each having an engagement hole 45 formed therethrough inside of a plate portion 44*a* of the double engagement member 44 at a right angle relative to the plate portion 44*a* along the opposite side edges of the latter. In practical use, the double engagement member 44, especially, the upper end part of the plate portion 44*a* is openably fitted into the opening portion 46 located below the front wall 42*a* of the housing main body 41 via a pair of thin-walled hinges 49 and a pair of hinge fitting base portions 49*a*.

The thin-walled hinges 49 are prepared in the form of a pair of rectangular band-shaped pieces each serving to connect the lower end of the front wall 42*a* to the hinge fitting base portion 49*a*. Each thin-walled hinge 49 is dimensioned to have a small thickness enough to allow each thin-walled hinge 49 to be deflected with a very low intensity of power without any possibility that opening and closing of the double engagement member 44 are undesirably obstructed. In addition, since each thin-walled hinge 49 has an adequately determined width, there does not arise a malfunction that bending of the thin-walled hinge 49 is achieved concentratively in a certain narrow region. Thus, local breakage of each thin-walled hinge 49 can be prevented regardless of repeated opening and closing operations of the double engagement member 44.

Primary engagement of the male terminal 50 with the terminal housing is achieved by way of the steps of first inserting the male terminal 50 into the main body 41 of the housing in the arrow-marked direction, bringing the opposite projections 52 projecting outside of an electrical contact portion 51 of the male terminal 50 in contact with the lower surface of the partition wall 56 of the housing main body 41, the front wall 43*a* of the lower housing main body 43 and the rear wall 43*b* of the same in order to prevent disconnection of the male terminal 50 from the housing main body 41 and vibrative displacement of the male terminal 50, and subsequently, bringing the housing lance 47 projecting from the housing main body 41 in engagement with an engagement hole 54 formed through a base plate 53 of the male terminal 50.

Next, double engagement is achieved by way of the steps closing the opening portion 46 of the housing main body 41 with the double engagement member 44 via the thin-walled hinges 49, bringing the engagement holes 45 formed through the side plates 44*b* in engagement with the engagement protuberances 48 on the housing main body 41 so as to hold the double engagement member 44 in the locked state, and subsequently, bringing an upper end surface 44*c* of the plate portion 44*a* in engagement with the lower surface of one of the projections 52 of the male terminal 50.

With the thin-walled hinges 49 designed in the above-described manner, however, when the opening portion 46 of the housing main body 41 is closed with the double engagement member 44, it is not always assured that they are bent at the central parts as seen in the opening/closing direction, i.e., in the longitudinal direction of the thin-walled hinges 49. For example, as shown in FIG. 7, there arises an occasion that the thin-walled hinges 49 are not bent at the central parts thereof as seen in the longitudinal direction but they are sharply bent at the positions offset away from the central parts. Thus, the fulcrum for turning movement of the thin-walled hinges 49 is dislocated from a predetermined position, causing a radius of turning movement of the thin-walled hinges 49 to vary. This leads to the result that there arises a malfunction that the engagement holes 45 on the double engagement member 44 do not reach the engagement protuberances 48 on the main body 41 of the housing or they pass past the engagement protuberances 48. In view of an occurrence of the foregoing malfunction, a highly trained skill is required for an operator in order to assure that the double engagement member 44 is correctly held on the housing main body 41 in the locked state. In addition, there is existent a certain limit when each of the thin-walled hinges 49 is designed to have a smaller thickness so as to allow them to be easily bent. If each thin-walled hinge 49 is designed to have an excessively small thickness, the strength of the thin-walled hinge 49 is undesirably reduced in excess of a predetermined level.

Therefore, in the case that two components to be detachably combined with each other are integrally connected to each other and disconnected from each other like the thin-walled hinges 49, there appears a problem that each inserting operation can not smoothly be performed when the aforementioned locking mechanism is employed for the thin-walled hinges 49 each including a fulcrum for turning movement thereof. In addition, when the thin-walled hinges 49 are bent at the positions offset away from predetermined ones, breakage is liable to occur at the sharply bent positions. If they are sharply bent while exhibiting an acute angle with the thin-walled hinges 49, operator's fingers are liable to collide against the sharply bent parts of the thin-walled hinges 49, resulting in his fingers being injured with them. Another problem is that the terminal housing exhibits poor appearance due to the presence of the sharply bent parts of the thin-walled hinges 49.

In the case that the double engagement member 44 is connected to the housing main body 41 via the thin-walled hinges 49 like the aforementioned terminal housing, if the thin-walled hinges 49 are sharply bent at the positions offset away from the predetermined ones when the opening portion 46 of the housing main body 41 is closed with the double engagement member 44, a certain intensity of power effective for slantwise raising up the upper end surface 44*c* of the plate portion 44*a* is exerted on the double engagement member 44 as shown in FIG. 8, resulting in the upper end surface 44*c* of the plate portion 44*c* failing to be engaged with the lower surface of one of the projections 52 of the male terminal 50. Thus, there is a possibility that double engagement can not reliably be achieved with the thin-walled hinges 49 designed in the above-described manner.

SUMMARY OF THE INVENTION

The present invention has been made in consideration of the aforementioned background and its object resides in providing a structure employable for a thin-walled hinge(s) which assures that there does not arise a malfunction that each thin-walled hinge is bent at the position offset away from a predetermined one and that an operation for connecting two components to each other and disconnecting from each other can be performed at an improved efficiency.

To accomplish the above object, the present invention provides a structure employable for a thin-walled hinge(s) wherein two components to be detachably combined with each other are integrally connected to each other, wherein each thin-walled hinge is molded such that the width of the thin-walled hinge extending from the connecting portion of one component to the connecting portion of other component is continuously reduced while the thin-walled hinge maintains a constant thickness therebetween.

With the structure as mentioned above, since a sectional area of each thin-walled hinge measured in the transverse direction varies in proportion to the bending moment exerted thereon, in the case that two components are connected to each other and disconnected from each other, a constant bending stress appears on each thin-walled hinge including a fulcrum for turning movement thereof in the longitudinal direction (i.e., in the bending direction). Thus, there does not arise a malfunction that the bending power is concentratively applied on a certain single location when the bending moment is exerted on each thin-walled hinge as the latter is turnably bent, whereby each thin-walled hinge can be deformed while exhibiting a constant curved configuration.

DETAILED DESCRIPTION OF THE PREFERRED EMBODIMENTS

The present invention will now be described in detail hereinafter with reference to the accompanying drawings which illustrate a few preferred embodiments thereof. Incidentally, FIG. 1 is a perspective view of a female connector and a male terminal to be connected to each other via thin-walled hinges constructed according to an embodiment of the present invention, FIG. 2 is a front view of the female connector, and FIG. 3 is a vertical sectional view of the female connector having the male terminal received therein.

Figure 1:
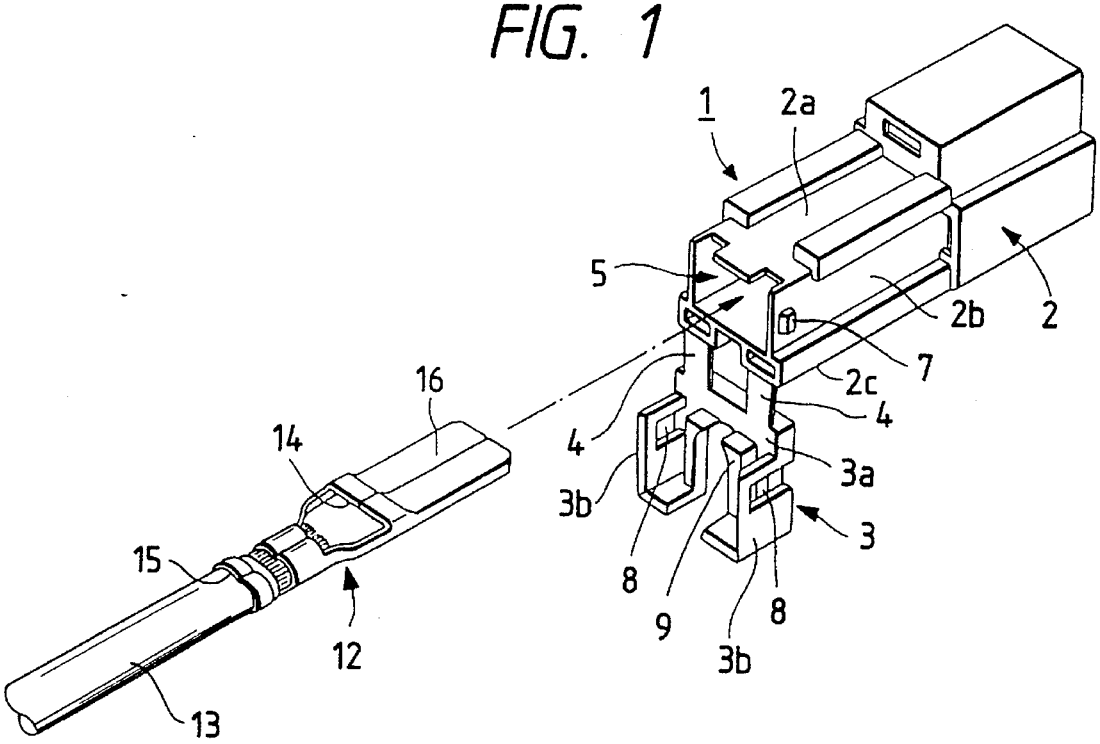
FIG. 1 is a perspective view of a female connector including a double engagement member adapted to be connected to the female connector via a pair of thin-walled hinges constructed according to an embodiment of the present invention.
Figure 2:
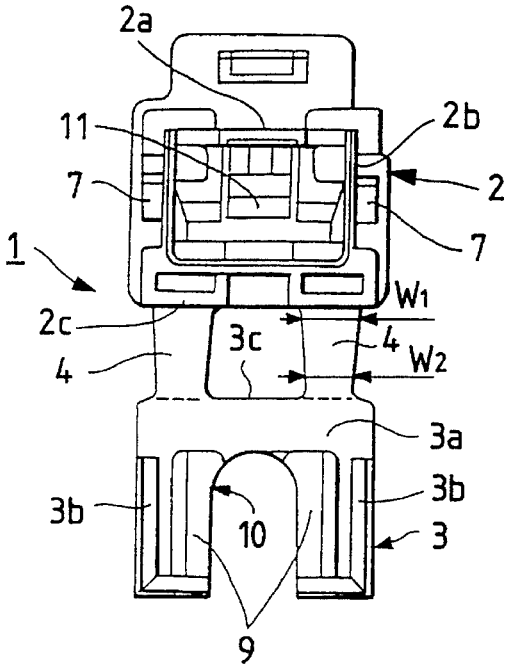
FIG. 2 is a front view of the female connector shown in FIG. 1.
Figure 3:
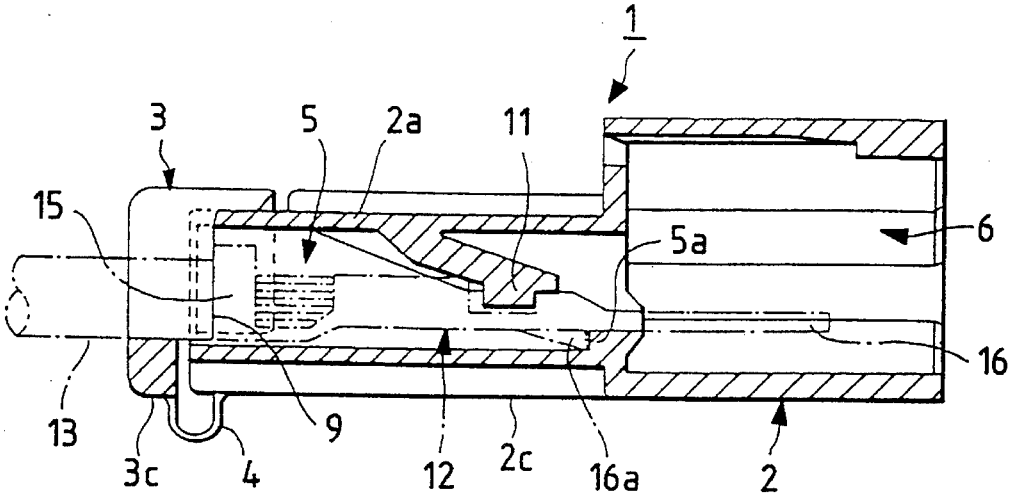
FIG. 3 is a vertical sectional view of the female connector shown in FIG. 1.

As shown in FIGS. 1–3, in this embodiment, a female connector 1 is composed of a housing main body 2 including a terminal receiving chamber 5 for receiving a male terminal 12 crimped on the right-hand end part of a cable 13, a connector receiving chamber 6 for receiving a male connector 21 to be described later, a double engagement member 3 for bringing the male terminal 12 received in the terminal receiving chamber 5 in double engagement with the female connector 1, and a pair of thin-walled hinges 4 for integrally connecting the housing main body 2 to the double engagement member 3.

The housing main body 2 is designed in the substantially box-shaped configuration of which opposite ends are kept open to the outside. A housing lance 11 serving as a primary engagement member for the male terminal 12 is disposed on the inner surface of an upper wall 2*a* of the terminal receiving chamber 5 having a height smaller than that of the connector receiving chamber 6 for receiving the male connector 21, while a pair of engagement protuberances 7 are disposed on the opposite side walls 2*b* of the housing main body 2 on the male terminal inserting side for holding the double engagement member 3 in the locked state.

The double engagement member 3 is designed such that side plates 3*b* each having an engagement recess 8 formed thereon are bent inward of a substantially inverted U-shaped plate portion 3*a* at a right angle relative to the latter along the opposite side edges of the same, and a base end edge 3*c* of the plate portion 3*a* located opposite to an open end edge of the plate portion 3*a* and having a cutout 10 formed for allowing a cable to pass therethrough is connected to a lower wall 2*c* of the terminal receiving chamber 5 via a pair of thin-walled hinges 4 such that the plate 3 is detachably fitted to an opening portion of the terminal receiving chamber 5.

The thin-walled hinges 4 are prepared in the form of a pair of rectangular band-shaped pieces for connecting the base end edge 3*c* of the plate 3*a* to the lower wall 2*c* of the housing main body 2 on the male terminal inserting side. To assure that opening and closing of the double engagement member 3 are not obstructed, each thin-walled hinge 4 has a small thickness so as to enable it to be deflected with a very low intensity of power. As is best seen in FIG. 2, each thin-walled hinge 4 extends from the connecting portion on the lower wall 2*c* side to the connecting portion on the plate 3 side with a constant thickness while gradually reducing a width thereof. Specifically, as shown in FIG. 2, each thin-walled hinge 4 is dimensioned to have a width $W_1$ on the housing main body 2 side larger than a width $W_2$ on the double engagement member 3 side.

With such construction, since a sectional area of each thin-walled hinge 4 measured in the transverse direction varies in proportion to the bending moment exerted on the thin-walled hinge 4 as the latter extends in the longitudinal direction (in the vertical direction as seen in FIG. 2), a constant bending stress appears on the thin-walled hinge 4 in the longitudinal direction (i.e., in direction coincident with the bending direction), and at this time, the thin-walled hinge 4 serves as a fulcrum for turning movement thereof induced as the double engagement member 3 is opened or closed. Thus, the thin-walled hinge 4 is smoothly deformed while exhibiting a constant curved contour without any concentration of the bending power at a specific location when the bending moment is exerted on the thin-walled hinge 4 due to the turning movement of the latter. At this time, it is not necessary to reduce the thickness of the thin-walled hinge 4 in excess of a preset level. Consequently, there do not arise malfunctions that the thin-walled hinge 4 is sharply bent at the position offset from the central part thereof as seen in the longitudinal direction, and moreover, the fulcrum of the thin-walled hinges 4 is dislocated from a predetermined position. It should be noted that the thin-walled hinges 4 may be designed such that the width of each thin-walled hinge 4 may be dimensioned to be continuously reduced from the connecting portion on the plate portion 3*a* side toward the lower wall 2*c* side.

Primary engagement of the male terminal 12 with the female connector 1 is achieved by way of the steps of first inserting the male terminal 12 into the terminal receiving chamber 5 of the housing main body 2 so as to allow an electrical contact portion 16 of the male terminal 12 to be engaged with a stepped part 5*a* formed on a lower wall 2*c* of the terminal receiving chamber 5 for preventing the male terminal 12 from being disconnected from the female connector 1 in the forward direction, and subsequently, bringing an engagement portion 14 formed on the upper surface of the electrical contact portion 16 at the rear end of the latter in engagement with the housing lance 11 disposed on the inner surface of the upper wall 2*a* of the terminal receiving chamber 5.

Next, as shown in FIG. 3, double engagement of the male terminal 12 with the female connector 1 is achieved by way of the steps of first closing an opening portion of the terminal receiving chamber 5 with the double engagement member 3 with the aid of the thin-wailed hinges 4, receiving the engagement protuberances 7 on the housing main body 2 in the engagement recesses 8 on the side plates 3*b* in the locked state, and engaging the rear end edge of a cable sheath caulking portion 15 of the male terminal 12 with an engagement stepped part 9 formed along the cable insert cutout portion 10.

At this time, the thin-walled hinges 4 are deformed while exhibiting a predetermined curved contour without any occurrence of a malfunction that they are sharply bent at the positions offset from the central parts thereof as seen in the longitudinal direction, causing the fulcrum for turning movement of the thin-walled hinges 4 to be dislocated from a predetermined position. Consequently, since the engagement protuberances 7 can be received in the engagement recesses 8 at the predetermined correct positions at all times, and moreover, the engagement stepped part 9 can be engaged with the rear end edge of the cable sheath caulking portion 15 at the predetermined correct position at all times, it is assured that the double engagement member 3 can easily and reliably be secured to the housing main body 2 in the locked state. This leads to the result that an operation for assembling the male terminal 12 with the female connector 1 can be performed at an improved efficiency.

In addition, since there do not arise malfunctions that the thin-walled hinges 4 are sharply bent, causing breakage to readily occur at the sharply bent parts of the thin-walled hinges 4, and moreover, operator's fingers are liable to collide against the sharply bent parts each having an acute angle, the female connector 1 exhibits excellent appearance on completion of the assembling operation.

Figure 4:
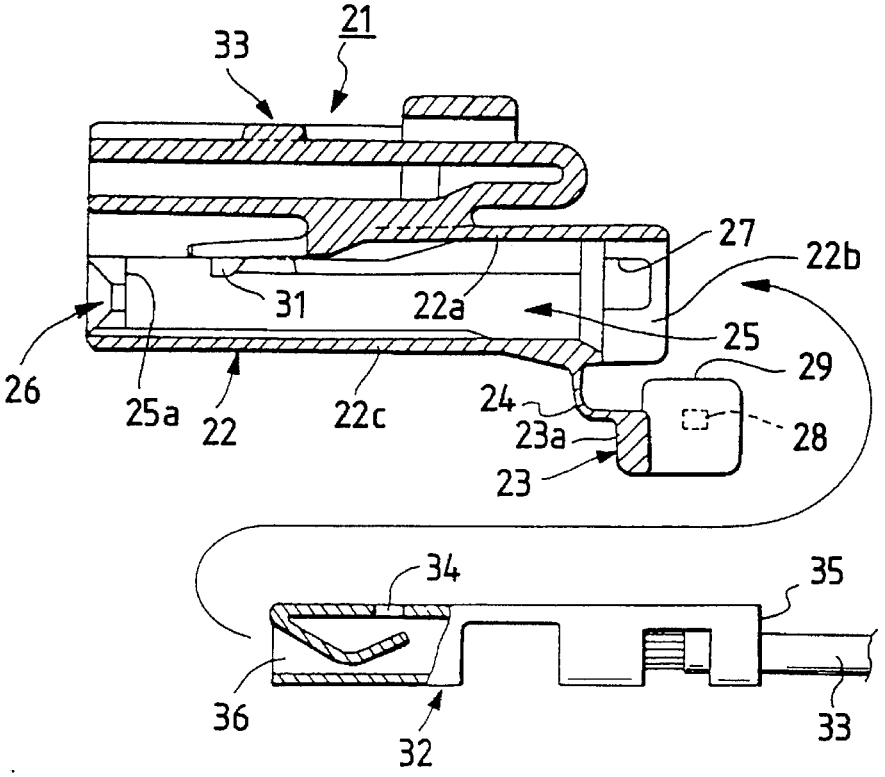
FIG. 4 is a vertical sectional view of a female connector including a double engagement member adapted to be connected to the female connector via a thin-walled hinge constructed according to another embodiment of the present invention.
Figure 5:
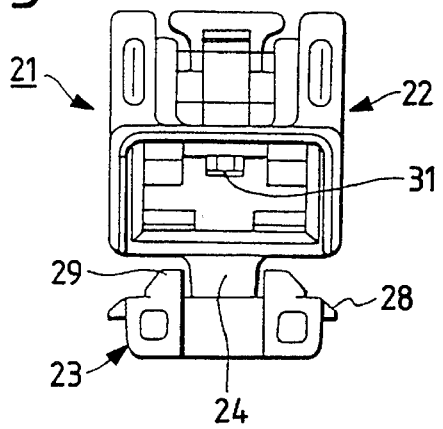
FIG. 5 is a front view of the female connector shown in FIG. 4.
Figure 6:
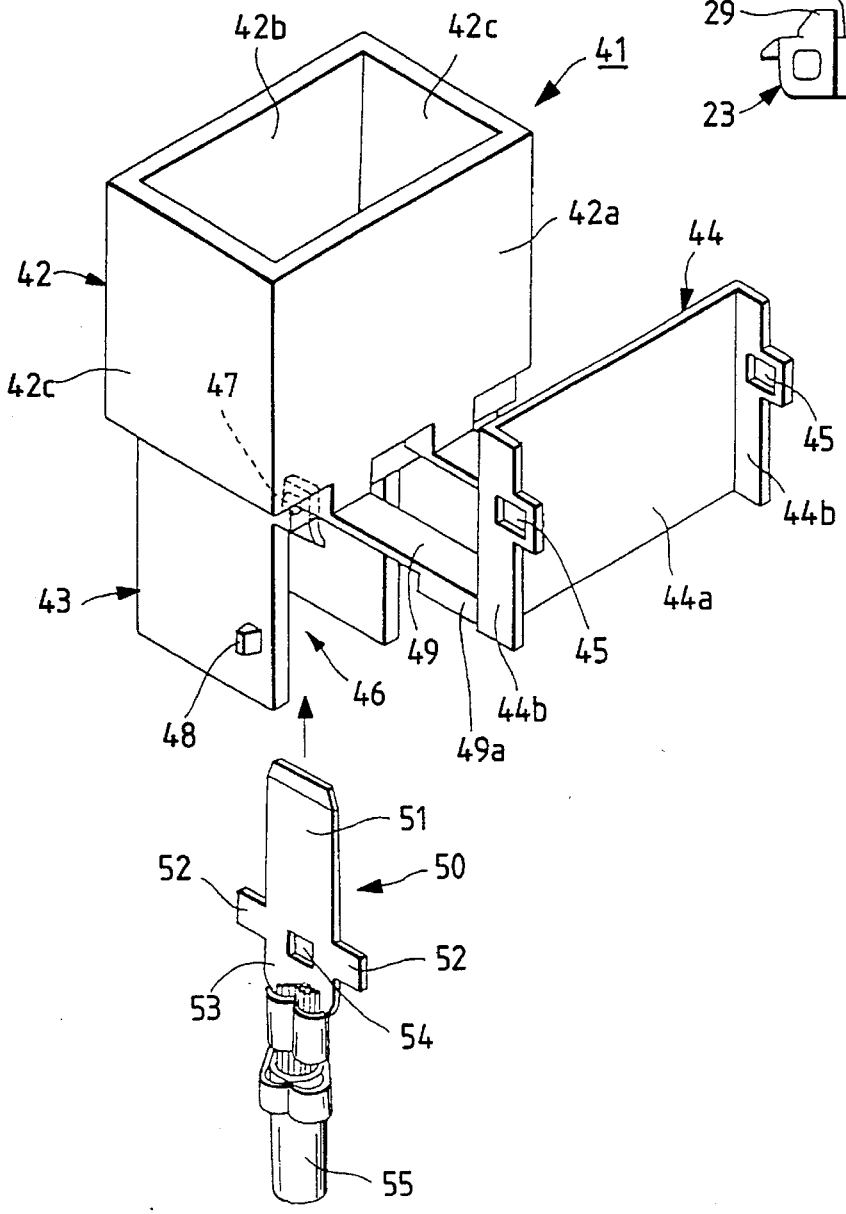
FIG. 6 PRIOR ART
FIG. 6 is a perspective view of a terminal housing including a double engagement member adapted to be connected to the terminal housing via a pair of conventional thin-walled hinges.
Figure 8:
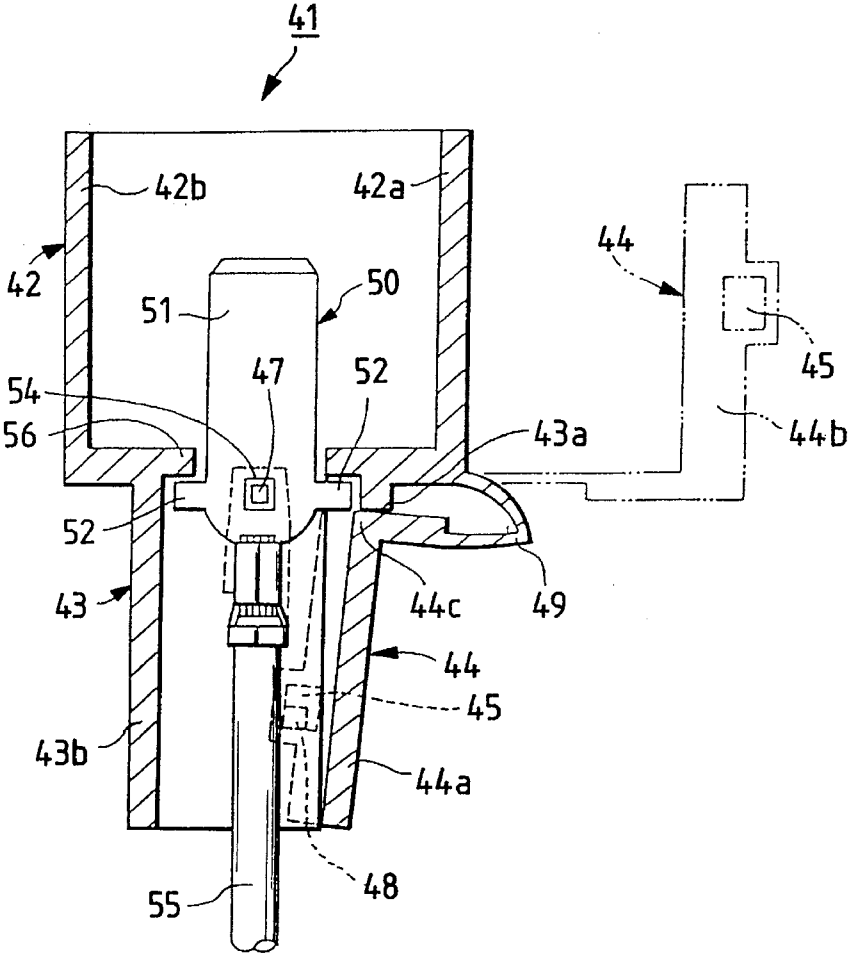
FIG. 8 PRIOR ART
FIG. 8 is a vertical sectional view of the terminal housing shown in FIG. 6, particularly showing that a male terminal is brought in double engagement with the terminal housing.
Figure 7:
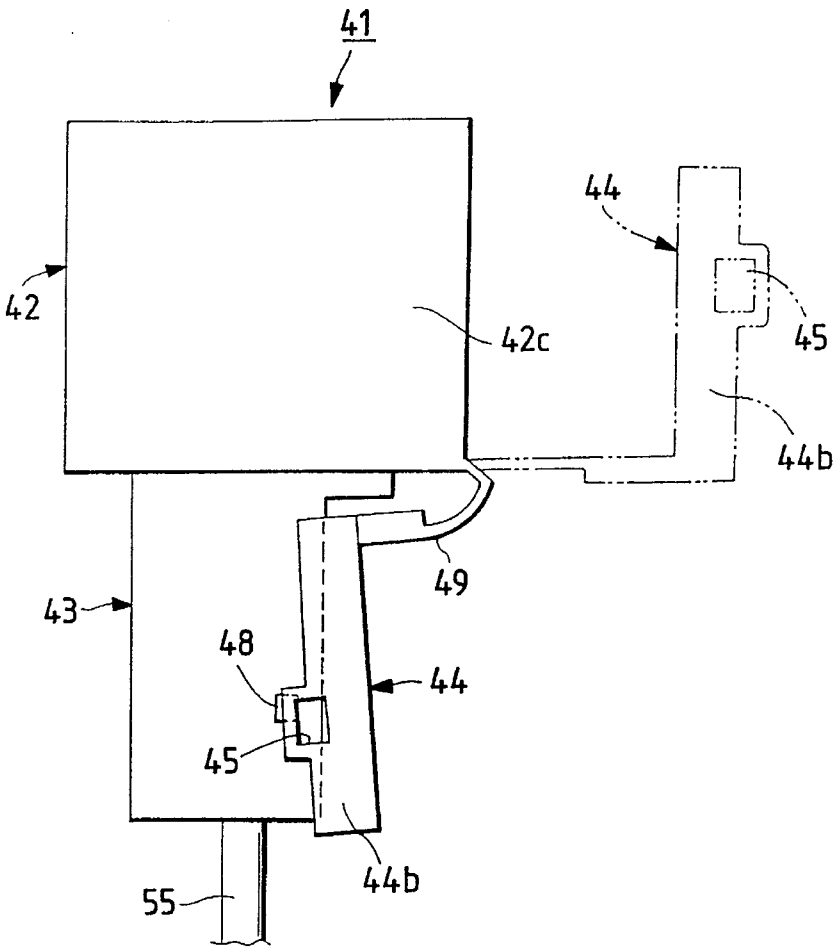
FIG. 7 PRIOR ART
FIG. 7 is a side view of the terminal housing shown in FIG. 6, particularly showing how a double engagement member is connected to the terminal housing.

FIG. 4 is a vertical sectional view of a structure employable for a thin-walled hinge constructed according to another embodiment of the present invention, particularly showing a female connector including a double engagement member to be secured thereto via the thin-walled hinge, and FIG. 5 is a front view of the structure shown in FIG. 4. Also in this embodiment, a male terminal is inserted into the female connector constructed in the substantially same manner as that in the preceding embodiment.

As shown in FIG. 4, in this embodiment, a female connector 21 is composed of a terminal receiving chamber 25 for receiving a male terminal 32 crimped on the left-hand end part of a cable 33, a terminal insert opening portion 26 for inserting a male terminal (not shown) into the female connector 21 after the male terminal 32 is inserted into the female connector 21, a housing main body 22 including a connector locking unit 30, a double engagement member 23 for bringing the male terminal 32 received in the terminal receiving chamber 25 in double engagement with the female connector 21, and a thin-walled hinge 24 for firmly connecting the double engagement member 23 to the housing main body 22.

The housing main body 22 is designed in the substantially box-shaped configuration of which opposite ends are kept open to the outside. A housing lance 31 serving as a primary engagement member is disposed on the inner surface of an upper wall 22*a* of the terminal receiving chamber 25, while a pair of engagement recesses 27 are formed on side walls 22*b* on the male terminal insert side for holding the double engagement member 23 in the locked state with the aid of the engagement recesses 27.

A pair of engagement protuberances 28 are disposed on the opposite side surfaces of the double engagement member 23 having a substantially U-shaped sectional contour, and a base end portion 23*a* of the double engagement member 23 is connected to a lower wall 22*c* of the terminal receiving chamber 25 on the male terminal insert side via the thin-walled hinge 4 so as to enable the double engagement member 23 to be detachably fitted into an opening portion of the terminal receiving chamber 25.

The thin-walled hinge 24 is designed in the form of a rectangular band-shaped piece for connecting the base end portion 23*a* of the double engagement member 23 to the lower wall 22*c* of the terminal receiving chamber 25 on the male terminal insert side. To assure that opening and closing of the double engagement member 23 are not obstructed by the thin-walled hinge 24, a thickness of the thin-walled hinge 24 is preset to be small in order to assure that the thin-walled hinge 24 can be deflected with a very low intensity of power, and the thin-walled hinge 24 is molded such that the width of each thin-walled hinge 24 is continuously reduced from the lower wall 22*c* of the female connector 21 toward the base end portion 23*a* thereof while a constant thickness of each thin-walled hinge 24 is maintained therebetween.

With this construction, since a sectional area of the thin-walled hinge 24 as measured in the transverse direction varies in the longitudinal direction in proportion to the bending moment exerted on the thin-walled hinge 24 in the same manner as the thin-walled hinges 4 in the preceding embodiment, a constant stress appears on the thin-walled hinge 24 in the longitudinal direction (i.e., in the direction coincident with the bending direction). Thus, the thin-walled hinge 24 is smoothly deformed with a predetermined curved contour not only without any necessity for reducing the thickness of the thin-walled hinge 24 in excess of a predetermined level but also without any possibility that the bending power is concentratively applied to a specific location on the thin-walled hinge 24 when the bending moment is exerted on the thin-walled hinge 24. Consequently, there does not arise a malfunction that the thin-walled hinge 24 is not bent at the central part thereof 24 as seen in the longitudinal direction but it is sharply bent at the position offset away from the foregoing central part, resulting in the fulcrum for turning movement of the thin-walled hinge 24 being dislocated from the original position.

Primary engagement of the male terminal 32 with the female connector 21 is achieved by way of the steps of first inserting the male terminal 32 into the terminal receiving chamber 25 of the housing main body 22, bringing the foremost end of an electrical contact portion 36 of the male terminal 36 in contact with a stepped part 25*a* formed in the terminal receiving chamber 25 for preventing the male terminal 32 from being disconnected from the female connector 21 in the forward direction, and subsequently, bringing an engagement hole 34 formed through the upper surface of the electrical contact portion 36 of the male terminal 32 in engagement with the housing lance 31 disposed on the inner surface of the upper wall 22*a* of the terminal receiving chamber 25.

Next, double engagement is achieved by way of the steps of fitting the double engagement member 23 into an opening portion of the terminal receiving chamber 25 via the thin-walled hinge 24, receiving the engagement protuberances 28 in the engagement recesses 27 on the double engagement member 23 in the locked state, and bringing a pair of engagement protuberances 29 on the double engagement member 23 in engagement with the rear end edge of a cable sheath caulking portion 35 of the male terminal 32.

At this time, since the thin-walled hinge 24 is deformed with a predetermined curved contour and the fulcrum for turning movement of the thin-walled hinge 24 is not dislocated from the original position because the thin-walled hinge 24 is not sharply bent at the position offset away from the central part of the latter as seen in the longitudinal direction, the engagement protuberances 28 can be engaged with the engagement recesses 27 at the predetermined positions at all times, and moreover, the engagement protuberances 29 can likewise be engaged with the rear end edge of the cable sheath caulking portion 35 of the male terminal 32 at the predetermined positions at all times. Thus, it is assured that the double engagement member 23 can reliably be fitted to the housing main body 22 in the locked state.

Consequently, an operation for assembling the male terminal 32 with the female connector 21 can be performed at an improved efficiency while the same advantageous effects as those of the male connector 1 in the preceding embodiment are unchangeably maintained with the aforementioned structure employable for the thin-walled hinge 24.

It should of course be understood that the present invention should not be limited only to the aforementioned two embodiments but adequate change or modification may be made with respect to the contour of each thin-walled hinge and the number of thin-walled hinges as desired.

While the present invention has been described above with respect to the thin-walled hinge(s) for connecting the double engagement member to the housing main body of the female connector, the present invention may equally be applied to various kinds of components each including a structure employable for a thin-walled hinge serving as a fulcrum for turning movement of the relevant component in the case that two components to be detachably combined with each other are integrally connected to each other and disconnected from each other.

As is apparent from the above description, according to the present invention, since each thin-walled hinge has a structure wherein the width of each thin-walled hinge is continuously reduced from the connecting portion of one component from the connecting portion of other component while the thin-walled hinge maintains a constant thickness therebetween, the sectional area of each thin-walled hinge measured in the transverse direction varies in proportion to a magnitude of bending moment exerted on the thin-walled hinge. Thus, in the case that two components are connected to each other and disconnected from each other, a constant bending stress uniformly appears in the longitudinal direction (i.e., in the direction coincident with the bending direction) of the thin-walled hinge. Consequently, when the bending moment is exerted on each thin-walled hinge, the latter can smoothly be deformed with a constant curved contour not only without any necessity for reducing the thickness of each thin-walled hinge in excess of a predetermined level, resulting in the strength of the thin-walled hinge being reduced but also without any possibility that the bending power is concentratively exerted on the thin-walled hinge.

Conclusively, the present invention can provide a structure employable for a thin-walled hinge(s) which assures that there does not arise a malfunction that each thin-walled hinge is undesirably bent and that an operation for connecting two components to each other and disconnected from each other can be performed at an improved efficiency.

What is claimed is:

1. A connector comprising:

a housing including an accommodating chamber for accommodating a terminal and a housing body, continuously formed to the accommodating chamber, for receiving another connector;

an engagement member for engaging the terminal with the housing, the engagement member being detachably engagable with an opening portion of the housing, said engagement member having a cutout portion, said cutout portion engaging and securing cable of the terminal when the terminal is inserted into said accommodating chamber and said engagement member is engaged with said opening portion;

a thin-walled hinge for connecting the housing to the engagement member, the thin-walled hinge being gradually reduced in width, wherein the hinge has a constant thickness and is rotated within 180 degrees to form an arc shape.

2. The connector as claimed in claim 1, wherein the housing includes an engagement protrusion retained with an engagement recess provided with the engagement member.

3. The connector as claimed in claim 1, wherein the housing includes an engagement recess retained with an engagement protrusion provided with the engagement member.

4. The connector as claimed in claim 1, wherein the thin-walled hinge is gradually reduced in width from the housing to the engagement member.

5. The connector as claimed in claim 1, wherein the thin-walled hinge is gradually reduced in width from the engagement member to the housing.

6. A structure for connecting two components of an electrical connector, wherein a hinge is formed in such a manner that a width of the hinge extending from a connecting portion of one component to a connecting portion of the other component is gradually and continuously reduced in width with a constant thickness, said hinge having a cutout portion, said cutout portion accommodating and securing a member to be inserted into one of said components and held by the other of said components, wherein said hinge is rotated within 180 degrees to form an arc shape.

* * * * *